United States Patent [19]

Mikuni

[11] Patent Number: 4,660,487

[45] Date of Patent: Apr. 28, 1987

[54] LOOP TAKER FOR SEWING MACHINES

[75] Inventor: Yoshio Mikuni, Osaka, Japan

[73] Assignee: Maruzen Sewing Machine Co., Ltd., Osaka, Japan

[21] Appl. No.: 788,102

[22] Filed: Oct. 16, 1985

Related U.S. Application Data

[63] Continuation of Ser. No. 615,739, May 31, 1984, abandoned.

[30] Foreign Application Priority Data

Mar. 14, 1984 [JP] Japan ..... 59-37111[U]

[51] Int. Cl.[4] ..... D05B 57/08

[52] U.S. Cl. ..... 112/230

[58] Field of Search ..... 112/184, 228, 229, 230, 112/231

[56] References Cited

U.S. PATENT DOCUMENTS

| | | | |
|---|---|---|---|
| 875,621 | 12/1907 | Parkes | 112/231 |
| 1,431,380 | 10/1922 | Dickson | 112/228 |
| 1,884,178 | 10/1932 | Parkes | 112/184 X |
| 2,941,488 | 6/1960 | Attwood | 112/228 |
| 3,140,681 | 7/1964 | Corey | 112/228 |
| 3,223,060 | 12/1965 | Corey | 112/228 |
| 3,611,962 | 10/1971 | Armao | 112/228 |
| 4,297,958 | 11/1981 | Adams | 112/184 X |
| 4,397,250 | 8/1983 | Zylbert et al. | 112/184 |
| 4,475,475 | 10/1984 | Zylbert | 112/228 |
| 4,488,499 | 12/1984 | Giaimo et al. | 112/230 |
| 4,493,278 | 1/1985 | Badillo | 112/184 |

FOREIGN PATENT DOCUMENTS

| | | | |
|---|---|---|---|
| 933601 | 9/1955 | Fed. Rep. of Germany | 112/230 |
| 2445466 | 9/1975 | Fed. Rep. of Germany | 112/184 |
| 728247 | 4/1955 | United Kingdom | 112/231 |

*Primary Examiner*—Wm. Carter Reynolds

*Attorney, Agent, or Firm*—Lowe, Price, Leblanc, Becker & Shur

[57] ABSTRACT

A loop taker (18) has a loop taker body (20) molded of resin in one piece, and a hook (22) made of metal. A rotary shaft (13) is fitted in the center of the loop taker (18), and a set screw (17) threadedly inserted in the end of this rotary shaft holds down the loop taker (18). A pin (36) fixedly installed on the rotary shaft (13) is fitted in a radially extending groove (37) in the loop taker (18), whereby the loop taker (18) is connected to the rotary shaft (13) so that it will not rotate relative to the rotary shaft.

16 Claims, 19 Drawing Figures

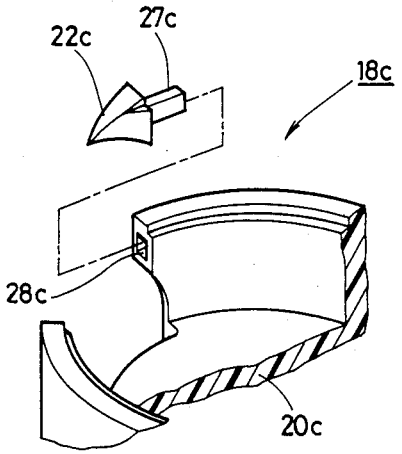
FIG. 7
FIG. 8
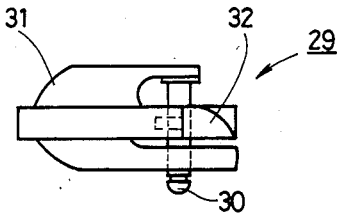
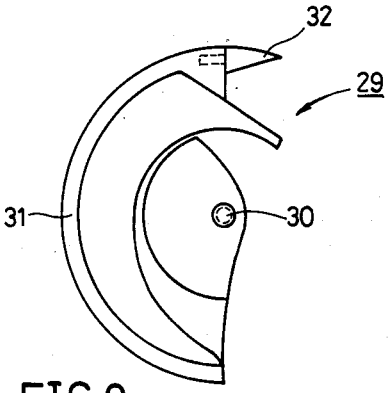
FIG. 9
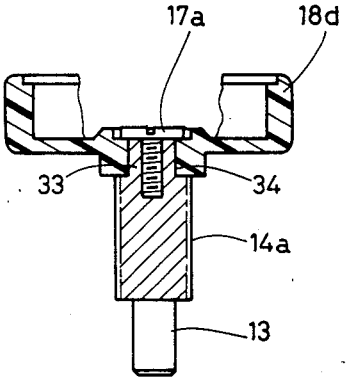
FIG. 10
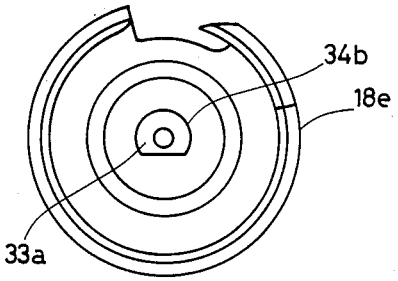
FIG. 11

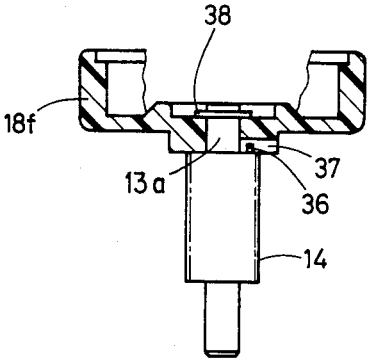
FIG. 12
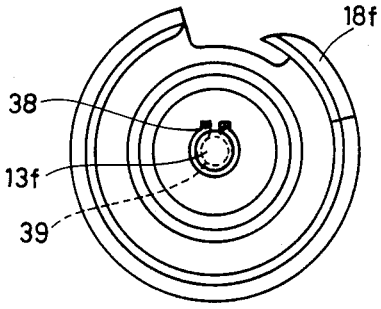
FIG. 13
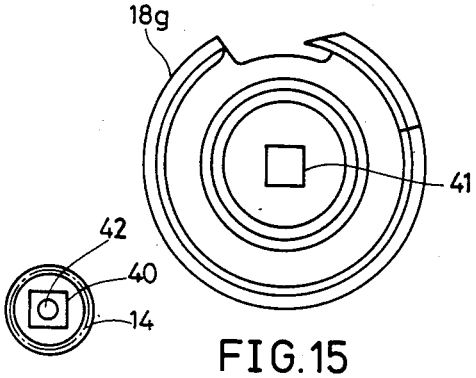
FIG. 15
FIG. 14
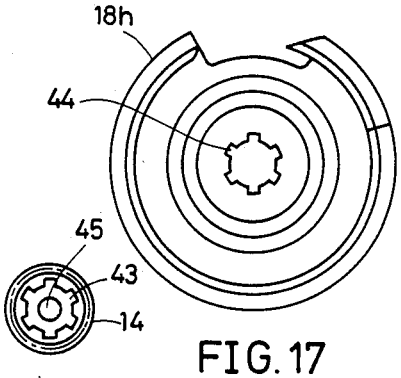
FIG. 17
FIG. 16

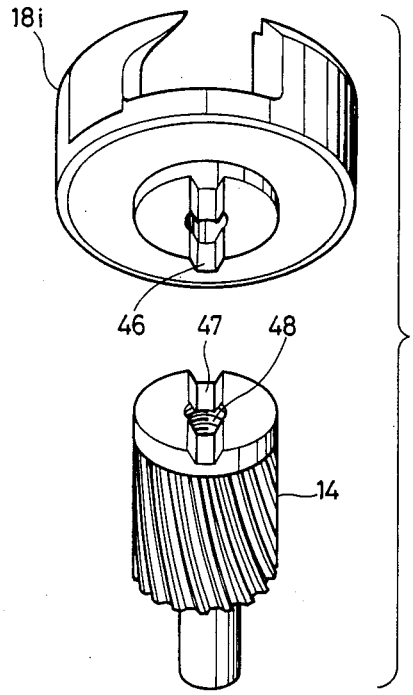
FIG. 18
FIG. 19
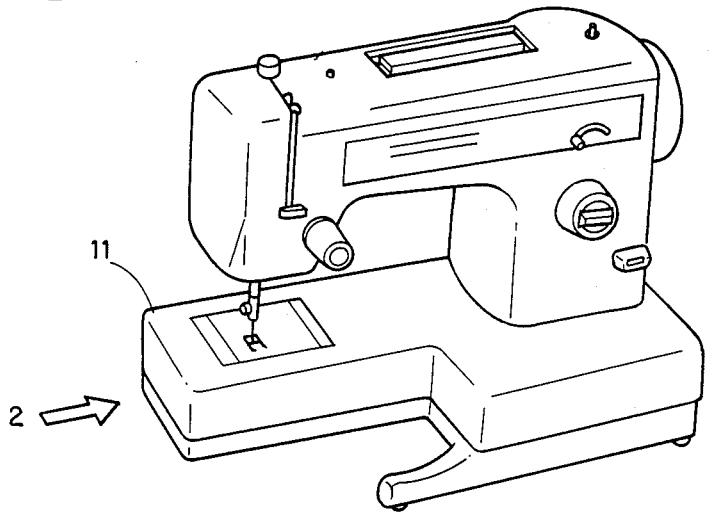

LOOP TAKER FOR SEWING MACHINES

This application is a continuation of application Ser. No. 615,739, filed May 31, 1984, now abandoned.

BACKGROUND OF THE INVENTION

This invention relates to a loop taker for sewing machines, having a hook for arresting a needle loop.

Loop takers having hooks are classified into two types, one used exclusively for household sewing machines in which the loop taker is oscillated, and the other used for industrial sewing machines and also for household sewing machines in recent years in which the loop taker is rotated in a horizontal plane. The manufacture of each type has involved a number of steps. For example, in the type in which the loop taker is rotated, roughly speaking its manufacture involves welding a ring-like metal part and a bottom lid to unite them, grinding a notch to form a hook, and removing burrs and buffing the surface to ensure smooth slide movement of the yarn, the operation amounting to as many as 30 steps. Similarly, the type in which the loop taker is oscillated requires a large number of manufacturing steps. Such largeness of the number of steps increases the manufacturing cost of the shuttle race and body assembly, and the larger the number of steps, the greater the percentage occurrence of reject parts, which, in turn, increases the manufacturing cost of the shuttle race and body assembly.

This problem can be solved by molding the loop taker of resin. Since the production of loop takers can be effected in one steps, the manufacturing cost is reduced to a large extent. Further, the molding of loop takers of resin provides the following advantages in addition to the reduction of manufacturing cost.

First, vibration and noise produced by the rotating or oscillating movement of the loop taker are absorbed. Such vibration and noise are produced when the needle loop passing over the loop taker comes out from between the loop taker and the shuttle driver, which is driven to oscillate the loop taker, at which time the two strike against each other, or when the needle loop comes out from between the bobbin case, which is carried by the loop taker, and the retainer of the bobbin case in order to pass over the bobbin case.

Second, the inertia force is reduced because of the reduction in weight.

Third, if a resin of satisfactory lubrication is used, this eliminates the need for oiling and produces no creak. If a resin having a low coefficient of friction is used, the loop taker will move smoothly.

However, a loop taker made of resin, as compared with one made of metal, has a disadvantage that its strength and wear resistance are low. This has been a major cause of baffling a realization of its practical use. This problem must be solved before a loop taker make of resin can be put to practical use.

The rotating type loop taker has another problem which follows.

When it is needed to replace the loop taker or to clean it, the dismounting and mounting of the loop taker is not easy. The need of replacing the loop taker arises (1) when the timing between the loop taker and the needle goes out of order or the needle is bent and hence the needle point strikes against the hook and thereby breaks or damages the hook, (2) when the loop taker is rusted, (3) when the yarn does not slide smoothly, and (4) when the loop taker is worn out. The need for cleaning the loop taker arises (1) when waste pieces of yarn have accumulated, and (2) when the yarn tends to be contaminated with lubricating oil or the like.

For example, in the type shown in FIG. 1 in which a loop taker 1 is rotated in a horizontal direction, the removal of the loop taker 1 would involve the following operation. First, a base cover 2 may be removed to loosen fixing screws 3 and then a driver shaft 4 may be withdrawn. However, since the loop taker 1 is generally provided with a gear 5 integral therewith, the withdrawal of the loop taker together with said gear 5 would be obstructed by such parts as a feed mechanism 6, a lower shaft 7, and a gear 8 meshing with the gear 5 and fixed on the lower shaft 7. Therefore, the downward withdrawal of the loop taker 1 is impossible. On the other hand, the upward withdrawal of the loop taker 1, which is not obstructed by the aforesaid machine elements, is not so easy since the space defined below the head 9 of the sewing machine is narrow.

SUMMARY OF THE INVENTION

A principal object of this invention is to make it possible to put a loop taker of resin to practical use by eliminating its drawback of being inferior in wear resistance.

A means for achieving said object is to use metal, such as iron, to form the hook which tends to be worn out by contact with the needle. Thus, the hook is made separately from the loop taker body. It is to be understood that a hook made of metal means not only a hook made entirely of metal but also a hook made of resin whose wearable portion is covered with a metal sheet.

Making the hook separately from the loop taker body is advantageous since even if either the hook or the loop taker happens to be a reject part, it is only necessary to replace the reject part; thus, as compared with a prior art case where local miss-processing means discard of the complete part, the loss is reduced and so is the manufacturing cost.

In accordance with one embodiment of the present invention, a loop taker for sewing machines has a hook for arresting a needle loop and is adapted to be rotated or oscillated around a predetermined axis. The loop taker comprises a loop taker body substantially, entirely molded or resin and having a base portion and a side wall projecting upward from the base portion. The hook is formed of metal or like material so as to have wear resistance and separately from the loop taker body. The hook has an L-shaped vertical cross-section defined by an upright side wall portion and a radially projecting portion having a downward facing surface extending inwardly from the upright side wall portion. The downward facing surface is in flush contact with a support surface formed on the loop taker body. The support surface and downward facing surface are generally parallel to a raceway formed on the loop taker body. The hook is fixed to the loop taker body, for example, with screws.

The upright side wall portion is an attaching portion through which the hook is attached to the loop taker body. The attachment portion, according to one embodiment of the invention, has a radial thickness less than the thickness of the side wall of the loop taker body. This attaching portion is mounted to a portion of the side wall of the loop taker body having lesser thickness than remaining portions of the loop taker side wall. The attaching portion is mounted by means of radially extending screws. In addition, the attaching portion is mounted in overlapping relation to the outer surface of the loop taker side wall portion of lesser thickness so that the resulting thickness of the overlapping portions is about equal to the thickness of the remaining portions of the side wall. The radially projecting portion extends inwardly to rest upon an upper edge of the loop taker side wall.

Preferably, the screws pass through an upper portion of the loop taker side wall. The radially projecting portion is formed with a raceway extending continuously with a raceway formed in an upper portion of the loop taker side wall and terminates in a hook point.

In accordance with another embodiment of the present invention, the radially projecting portion projects orthogonally from a lower edge of the upright side wall portion. The base of the loop taker body is formed with a peripheral portion of lesser thickness than the remaining portions of the base. The radially projecting portion is mounted in overlapping relation to the top surface of the base portion of lesser thickness and is secured thereto by means of screws passing through the overlapping portions.

Another means for achieving the aforesaid object is to make a loop taker of resin while vapor-depositing metal, such as nickel, on the hook, preferably the hook and other portions requiring wear resistance, including rubbing portions.

A further means for achieving said object is to perform two-stage molding wherein portions requiring wear resistance are made of wear-resistant resin, such as polyamide resin, while the other portions are made of ordinary resin, such as acrylonitrile-butadiene-styrene resin.

In addition, even if loop takers according to this invention are constructed so that their hook portions have wear resistance, since the loop taker bodies are made of resin, it cannot be denied that the loop takers of the invention are inferior in durability to conventional loop takers made entirely of metal. Therefore, in a preferred embodiment of the invention, there is provided an arrangement which facilitates the dismounting and mounting of loop takers.

These objects and other objects, features, aspects and advantages of the present invention will become more apparent from the following detailed description of the present invention when taken in conjunction with the accompanying drawings.

BRIEF DESCRIPTION OF THE DRAWINGS

FIGS. 5, 6, and 7 are fragmentary enlarged perspective views of loop takers according to other embodiments of the invention, respectively, with the hooks shown removed from the respective loop taker bodies;

FIG. 8 is a plan view of a further embodiment of the invention, showing a loop taker of the oscillating type;

FIG. 9 is a front view of the loop taker of FIG. 8;

FIG. 10 is a sectional view of a loop taker adapted to rotate in a horizontal plane, showing a first embodiment concerning a removable arrangement applied to loop takers;

FIG. 11 is a plan view of a loop taker, showing an arrangement in which a removable loop taker is provided with rotation preventing means;

FIG. 12 is a sectional view of a loop taker, showing a second embodiment concerning the removable arrangement applied to loop takers and also showing rotation preventing and positioning means added to the loop taker;

FIG. 13 is a plan view of the loop taker shown in FIG. 12;

FIGS. 14 and 15 are views for explaining other examples of the loop taker rotation preventing means, of which FIG. 14 is a plan view of shaft means for rotatively driving the loop taker and FIG. 15 is a plan view of the loop taker;

FIGS. 16 and 17 are views for explaining other examples of the loop taker rotation preventing means, of which FIG. 16 is a plan view of shaft means for rotatively driving the loop taker and FIG. 17 is a plan view of the loop taker;

FIG. 18 shows loop taker rotation preventing means, with the loop taker shown in a perspective view as seen from obliquely below and the shaft means shown in a perspective view as seen from obliquely above; and FIG. 19 is an external perspective view showing an example of a sewing machine having a loop taker of this invention.

DESCRIPTION OF THE PREFERRED EMBODIMENTS

Figure 1:
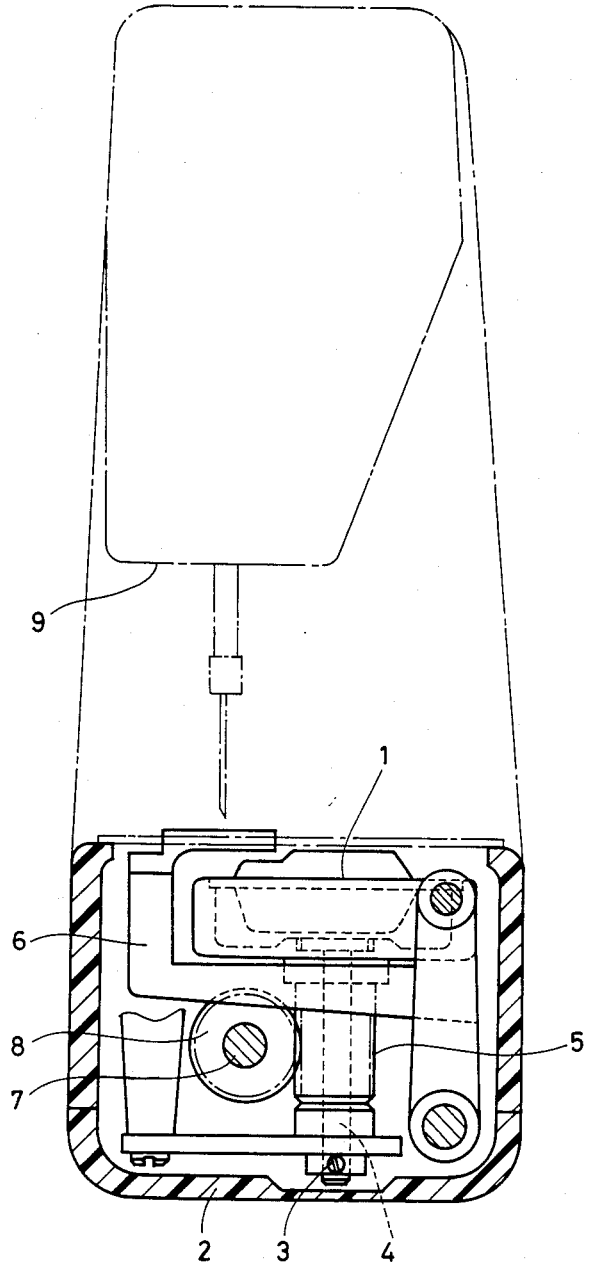
FIG.1 PRIOR ART
FIG. 1 is a view showing, partly in section, a conventional typical sewing machine having a loop taker adapted to rotate in a horizontal plane.
Figure 2:
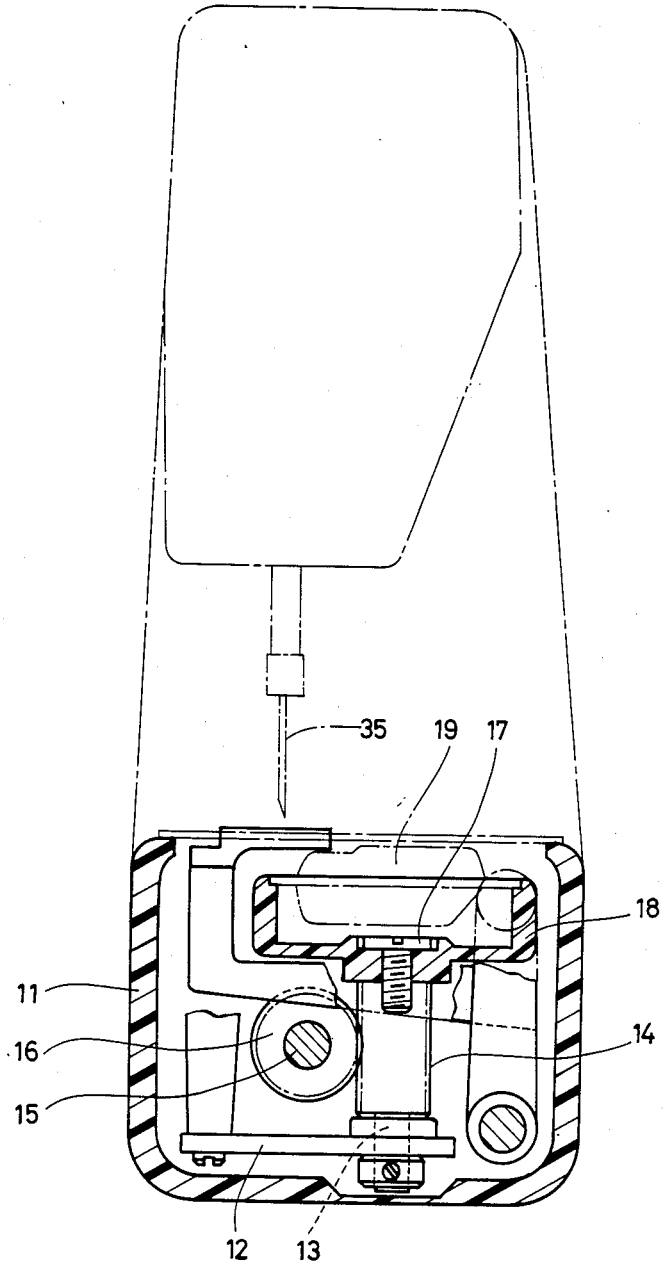
FIG. 2 is a view showing, partly in section, a sewing machine having a loop taker adapted to rotate in a horizontal plane, according to an embodiment of the invention.

FIG. 19 shows the external appearance of a sewing machine having applied thereto a loop taker according to this invention. A sectional view taken in the direction of arrow 2 of FIG. 19 is shown in FIG. 2. In addition, FIG. 1 previously described is also taken in the same direction.

In FIG. 2, a rotary shaft 13 rotatably supported by a support 12 within a bed 11 holds a spiral gear 14 on its outer peripheral surface and rotates integrally with said spiral gear 14. The spiral gear 14 meshes with a spiral gear 16 on a lower shaft 15, whereby rotary driving force imparted to the lower shaft 15 is transmitted to the rotary shaft 13 and hence the latter is rotated. A loop taker 18 is removably installed on the upper end of the spiral gear 14 by a set screw 17. Thus, the loop taker 18 is so held that it can be rotated together with the rotary shaft 13 in a horizontal plane. A bobbin case 19 is stationary held in a hold (not shown). The loop taker 18 rotates around the bobbin case 19.

Figure 3:
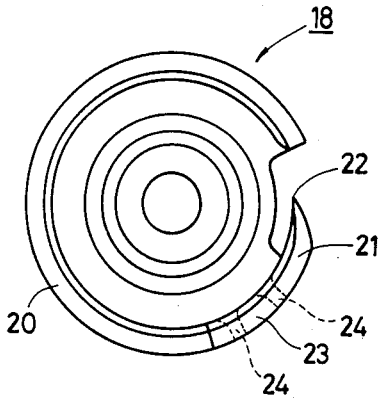
FIG. 3 is a plan view of the loop taker of FIG. 2, wherein the hook is formed of a press-worked metal sheet.
Figure 4:
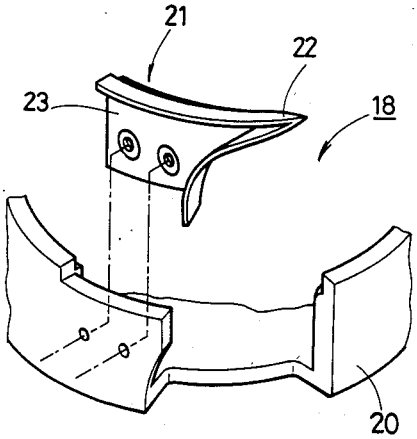
FIG. 4 is a fragmentary enlarged perspective view showing the loop taker of FIG. 3, with the hook shown removed from the loop taker body.

As shown in FIGS. 3 and 4, the loop taker 18 is composed of two parts, a loop taker body 20 and a hooked attachment 21. The loop taker body 20 is molded of resin in one piece. The hooked attachment 21 is formed of a press-worked metal sheet. The hooked attachment 21 is formed with a hook 22 and an attaching portion 23. The hooked attachment 21 is attached at its attaching portion 23 to the inner periphery of the loop taker body 20 by set screws 24.

Figure 5:
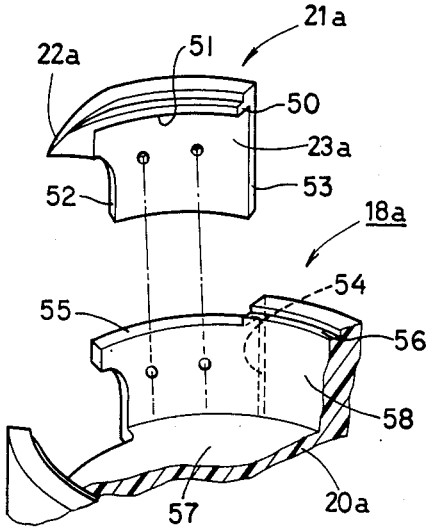

In a loop taker 18*a* having a base portion 57 and a side wall 58 as shown in FIG. 5, a hooked attachment 21*a* is made of metal by casting and forging, preferably cold forging. The hooked attachment 21*a* has a hook 22*a* and an attaching portion 23*a*. The hooked attachment 21*a* is attached at its attaching portion 23*a* to the outer periphery of the loop taker body 20*a* by set screws (not shown). More specifically, hook 22*a* is formed on hook attachment 21*a* having an L-shaped vertical cross-section defined by an upright side wall or attaching portion 23*a* and a radially projecting portion 50 having a downward facing surface 51 extending inwardly from the upright side wall portion. The upright side wall 23*a* extends continuously between a pair of generally-vertical edges 52 and 53 thereof with the hook 22*a* projecting from one of said edges 52 with the other of said edges 53 adapted to generally abut against a generally vertical edge 54 of the loop taker body 20*a* when the hooked attachment 21*a* is fixed thereto. The upright side wall 23*a* also extends substantially continuously from the radially projecting portion 50 along substantially the entire height of the hooked attachment. The downward facing surface 51 is in flush contact with a support surface 55 formed on the loop taker body 20*a*. The support surface 55 and downward facing surface 51 are generally parallel to a raceway 56 formed on the loop taker body.

Figure 6:
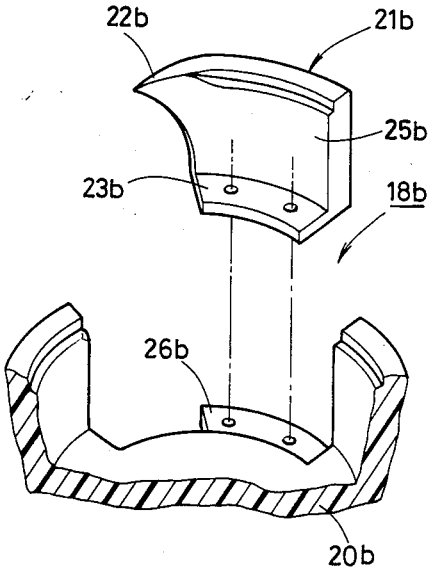

A loop taker 18*b* shown in FIG. 6 is composed of a loop taker body 20*b* and a hooked attachment 21*b*. The hooked attachment 21*b* is obtained by using the same material and same processing method as in the hooked attachment 21*a* shown in FIG. 5. The hooked attachment 21*b* has a hook 22*b*, an attaching portion 23*b*, and a peripheral side portion or upright side wall 25*b*. The hooked attachment 21*b* is attached at its attaching portion 23*b* to the attaching portion 26*b* of the loop taker body 21*b* by set screws (not shown). In this attached state, the peripheral side portion 25*b* forms a portion nearer to the hook, i.e., the portion which should originally constitute the peripheral side of the loop taker.

A loop taker 18*c* shown in FIG. 7 has only its hook 22*c* made of metal. The hook 22*c* is integrally formed with an insert portion 27*c* adapted to fit in a fitting hole 28*c* formed in the loop taker body 20*c*, whereby the hook 22*c* is attached to the loop taker body 20*c*. In addition, fitting of the insert portion 27*c* into the fitting hole 28*c* may be forcibly effected so that such fitting itself is sufficient to fix the hook 22*c* to the loop taker body 20*c* or it may be combined with the use of a set screw or an adhesive agent.

The embodiments described above refer to the rotating type loop taker, but in the oscillating type loop taker the hook may be similarly made of metal while making the loop taker body of resin.

An example is shown in FIGS. 8 and 9. In FIGS. 8 and 9, a loop taker 29 is of the type adapted to be oscillated around the axis of a shaft 30. The loop taker 29 is composed of a loop taker body 31 made of resin and a hook 32 made of metal. The hook 32 is of substantially the same shape as the hook 22*c* shown in FIG. 7 and substantially the same attaching means is employed.

In the above embodiments, the hook is made of metal. However, the arrangement for imparting wear resistance to the hook while making the loop taker body of resin is not limited to the manners described above, and the following method may also be used. That is, the entire loop taker including the hook may be made of resin while applying vapor deposition of metal to the hook, preferably to the hook and the portions of the loop taker body rubbed by the yarn, more preferably to the entire loop taker. Further, the loop taker may be formed in two steps by making the hook and rubbed portions of wear resistant resin in advance and then, with these positioned in a mold, performing the molding of the loop taker using ordinary resin. In each case, since wear resistance is imparted to the hook, or the most wearable portion, even if the loop taker body is made of resin the loop taker can be put to practical use.

In cases where at least a portion of the loop taker is made of resin, the need for replacement due to wear will arise more frequently than where it is made of metal. Further, even in the case of a loop taker made of metal, it sometimes becomes necessary to remove it for cleaning or other purposes. The loop taker 18 shown in FIG. 2 can be easily attached to or detached from the spiral gear 14 by tightening or loosening the set screw 17, but in attachment it is necessary to align the loop taker axially with the rotary shaft 13. In the arrangement shown in FIG. 2, the positioning for aligning them with each other is effected by the alignment between a tapped hole formed in the upper end of the spiral gear 14 and a tapped hole formed in the center of rotation of the loop taker 18. Further, their alignment may be attained in a manner shown in FIG. 10.

FIG. 10 shows an example in which a fitting shaft 33 projects from the upper end of a spiral gear 14*a* and adapted to fit in a fitting hole 34 in a loop taker 18*d*. The loop taker 18*d* and the spiral gear 14*a* are fixed together by an attaching screw 17 having a head larger in diameter than the fitting hole 34. In addition, in the example shown in FIG. 10, the fitting shaft 33 may be formed as an extension of the rotary shaft 13.

It is desirable that the loop taker 18 attached to the spiral gear 14 or to the rotary shaft 13 be provided with rotation preventing means so that when the set screw 17 is loosened during use, the loop taker will not deviate in the direction of rotation to upset the timing with respect to the needle 35 (FIG. 2). An example of rotation preventing means is shown in FIG. 11.

Referring to FIG. 11, a fitting shaft 33*a* formed on the upper end of the spiral gear and a fitting hole 34*b* in a loop taker 18*e* to receive it each have a cross-sectional shape in the form of a chipped circle.

FIGS. 12 and 13 show another example of rotation preventing means. A rotary shaft 13*a* projects from the upper end surface of the spiral gear 14. A pin 36 projects from the upper end surface of the spiral gear 14 so that it is parallel to the rotary shaft 13*a*. Further, the lower surface of a loop taker 18*f* is formed with a radially extending groove 37, in which the pin 36 is fitted. Such rotation preventing means also has the function of positioning means in rotative direction needed for establishing the timing with respect to the needle (FIG. 2) when the loop taker 18*f* is set in position, whereby the attachment of the loop taker 18*f* is further facilitated. Further, in this embodiment, because of the provision of the rotation preventing means, it is possible to use a C-shaped stop ring 38 or E-shaped stop ring (not shown) rather than a set screw (such as the set screw 17*a* of FIG. 10). For example, the C-shaped ring 38 is fitted in a circumferentially extending peripheral groove 39 formed in the end of a rotary shaft 13*f* projecting from the bottom surface of the loop taker 18*f*, whereby the spiral gear 14 and the loop taker 18*f* are fixed together.

FIGS. 14 and 15 show a further example of rotation preventing means. That is, the spiral gear 14 is formed with a spigot 40 of quadrilateral cross-section, while a loop taker 18*g* is formed with a socket 41 whose cross-sectional shape is substantially the same as that of the spigot 40. When the spigot 40 is fitted in the socket 41, the rotation preventing function is developed. In addition, for fixing the spiral gear 14 and loop taker 18*g*, a set screw (not shown) is used in the manner shown in FIG. 10, and for this purpose a tapped hole 42 is formed in the spigot 40.

As a variation of the example shown in FIGS. 14 and 15, the sides where the spigot and the socket are provided, respectively, may be interchanged.

FIGS. 16 and 17 show still another example of rotation preventing means. The spiral gear 14 is formed with spline teeth 43, while a loop taker 18*h* is formed with a fitting hole 44 for receiving the spline teeth 43. In this example, too, a set screw is used and hence a tapped hole 45 therefor is formed in the spline teeth 43.

In addition, as a modification of the example shown in FIGS. 16 and 17, the sides where the spline teeth and the fitting hole are provided, respectively, may be interchanged.

FIG. 18 shows yet another example of rotation preventing means. In this example, a loop taker 18*i* is formed with a radially extenting ridge 46, while the spiral gear 14 is formed with a likewise radially extending recess 47. With the ridge 46 fitted in the recess 47, a set screw (not shown) is threadedly inserted in a tapped hole 48, whereby the loop taker 18*i* is fixed to the spiral gear 14. In addition, the tapers appearing on both sides of the ridge 46 and recess 47, respectively, provide an advantage that the aforesaid fitting can be easily attained.

In addition, as a modification of the example shown in FIG. 18, the sides where the ridge and the recess are formed, respectively, may be interchanged.

Although the present invention has been described and illustrated in detail, it is clearly understood that the same is by way of illustration and example only and is not to be taken by way of limitation, the scope of the present invention being limited only by the terms of the appended claims.

What is claimed is:

1. A loop taker for sewing machines, having a hook for arresting a needle loop and adapted to be rotated or oscillated around a predetermined axis, said loop taker comprising a loop taker body substantially entirely molded of resin and having a base portion and a side wall projecting upward from the base portion, said hook being formed of metal so as to have wear resistance and separately from said loop taker body, said hook being formed on a hooked attachment having a generally L-shaped vertical cross-section defined by an upright side wall portion and a radially projecting portion having a downward facing surface extending inwardly from the upright side wall portion, said upright side wall extending continuously between a pair of generally vertical edges thereof with the hook projecting from one of said edges with the other of said edges adapted to generally abut against a generally vertical edge of the loop taker body when the hooked attachment is fixed thereto, said upright side wall extending substantially continuously from the radially projecting portion along substantially the entire height of the hooked attachment, said downward facing surface being in flush contact with a support surface formed on the loop taker body, said support surface and downward facing surface being generally parallel to a raceway formed on the loop taker body, and means for fixing said hook to the looptaker body, wherein said upright side wall portion is an attaching portion through which said hook is attached to the loop taker body, said attaching portion having a radial thickness less than the thickness of the side wall of the loop taker body.

2. A loop taker as set forth in claim 1 wherein said hook is formed by cold forging.

3. A loop taker as set forth in claim 1, wherein said hook has its surface formed by vapor deposition of metal.

4. A loop taker as set forth in claim 1, wherein said hook is made of wear resistant resin.

5. A loop taker as set forth in claim 1, wherein said loop taker is adapted to be rotated and is removably attached by fixing means to shaft means which rotates said loop taker.

6. A loop taker as set forth in claim 5, wherein said fixing means is a set screw.

7. A loop taker as set forth in claim 5, wherein said loop taker is connected to said shaft means so that their rotation relative to each other is inhibited by rotation preventing means.

8. A loop taker as set forth in claim 5, wherein the end of said shaft means projects through said loop taker, and this projecting portion is formed with a circumferential groove, said fixing means being in the form of a stop ring adapted to fit in said groove.

9. A loop taker as set forth in claim 7, wherein said rotation preventing means comprises, in combination, a socket having a cross-sectional shape in the form of a chipped circle, and a spigot whose cross-sectional shape is substantially the same as that of said socket so that it is fitted in said socket.

10. A loop taker as set forth in claim 7, wherein said rotation preventing means comprises, in combination, a socket of quadrilateral cross-section, and a spigot whose cross-sectional shape is substantially the same as that of said socket so that it is fitted in said socket.

11. A loop taker as set forth in claim 7, wherein said rotation preventing means comprises, in combination, a projection extending from either said loop taker or said shaft means at a position deviating from their rotational axis, and a recess formed in the other and adapted to receive said projection.

12. A loop taker as set forth in claim 7, wherein said rotation preventing means comprises, in combination, a pin projecting from either said loop taker or said shaft means at a position deviating from their rotational axis, and a recess formed in the other and adapted to receive said pin.

13. A loop taker as set forth in claim 7, wherein said rotation preventing means comprises, in combination, spline teeth formed on either said loop taker or said shaft means, and a fitting hole formed in the other and adapted to receive said spline teeth.

14. A loop taker for sewing machines, having a hook for arresting a needle loop and adapted to be rotated or oscillated around a predetermined axis, said loop taker comprising a loop taker body substantially entirely molded of resin and having a base portion and a side wall projecting upward from the base portion, said hook being formed of metal so as to have wear resistance and separately from said loop taker body, said hook having an L-shaped vertical cross-section defined by an upright side wall portion and a radially projecting portion having a downward facing surface extending inwardly from the upright side wall portion, said downward facing surface being in flush contact with a support surface formed on the loop taker body, said support surface and downward facing surface being generally parallel to a raceway formed on the loop taker body, and means for fixing said hook to the loop taker body, wherein said upright side wall portion is an attachment portion through which said hook is attached to the loop taker body, said attaching portion having a radial thickness less than the thickness of the side wall of the loop taker body, said attaching portion being mounted to a portion of the side wall of the loop taker body having lesser thickness than remaining portions of said loop taker side wall, said attaching portion being mounted by means of radially extending screws, said attaching portion thereby being mounted in overlapping relation to the outer surface of said loop taker side wall portion of lesser thickness so that the resulting thickness of said overlapping portion is about equal to the thickness of the remaining portions of said side wall, said radially projecting portion extending inwardly to rest upon an upper edge of said loop taker side wall.

15. The loop taker of claim 14, wherein said screws pass through an upper portion of the loop taker side wall.

16. The loop taker of claim 15, wherein said radially projecting portion is formed with a raceway extending continuously with a raceway formed in an upper portion of the loop taker side wall and terminating in a hook point.

* * * * *